US006032927A

United States Patent [19]

Atkinson

[11] Patent Number: 6,032,927

[45] Date of Patent: Mar. 7, 2000

[54] EASY NAIL PULLING HAMMER

[76] Inventor: John Atkinson, 604 W. Palmyra Ave., Orange, Calif. 92868

[21] Appl. No.: 09/002,771

[22] Filed: Jan. 5, 1998

[51] Int. Cl.[7] ..... B25C 11/00

[52] U.S. Cl. ..... 254/26; 254/26 E; 254/27

[58] Field of Search ..... 254/26 R, 26 E, 254/27, 21, 19

[56] References Cited

U.S. PATENT DOCUMENTS

| | | | |
|---|---|---|---|
| D. 30,786 | 5/1899 | Brownell . | |
| D. 35,203 | 10/1901 | Tarbell | 254/26 R |
| 559,049 | 4/1896 | Blydenburgh . | |
| 724,542 | 4/1903 | Brownell | 254/26 R |
| 778,093 | 12/1904 | Witmer | 254/26 R |
| 859,796 | 7/1907 | Bacon . | |
| 1,415,369 | 8/1922 | Coleman . | |
| 1,425,369 | 8/1922 | Coleman | 254/26 R |
| 1,515,142 | 11/1924 | Butler . | |
| 1,535,685 | 4/1925 | Randell et al. . | |
| 1,550,405 | 8/1925 | Williams | 254/26 R |
| 3,885,772 | 5/1975 | Balkus, Jr. | 254/26 R |
| 4,482,132 | 11/1984 | Lamansky . | |
| 5,249,776 | 10/1993 | Johnson . | |
| 5,622,352 | 4/1997 | Swindoll | 254/26 R |

*Primary Examiner*—David A. Scherbel
*Assistant Examiner*—Lee Wilson
*Attorney, Agent, or Firm*—Price, Gess & Ubell

[57] ABSTRACT

A hammer with a conventional open V-claw has a second hook claw located below the V-claw which is large enough to accept any size nail heads. The second claw is placed so as to grip a nail in a direction that is opposite to the conventional V-claw. The second claw may be a loop, V-shaped, or an open hook mounted below the standard V-claw on the body of the hammer head, or on the V-claw itself.

5 Claims, 4 Drawing Sheets

EASY NAIL PULLING HAMMER

BACKGROUND OF THE INVENTION

1. Field of the Invention

The present hammer invention relates to hammers with nail pulling apparatus and more particularly pertains to new and improved nail-pulling hammers wherein nails of any size may be pulled faster and more easily.

2. Description of Related Art

By way of example, the prior art includes U.S. Pat. No. 559,049 patented Apr. 28, 1896; U.S. Pat. No. 30,786 patented May 16, 1899; U.S. Pat. No. 724,542 patented Apr. 7, 1903; U.S. Pat. No. 1,425,369 patented Apr. 8, 1922; and U.S. Pat. No. 1,535,685 patented Jun. 9, 1924.

Prior art hammers designed for pulling nails of various length usually use more than one claw carried on the head. The shortcomings of such a design were the extra weight, an inability to stand the strain caused from heavy pulling of difficult nails, and the added expense of manufacturing added claws.

Commonly available hammers today all have a single nail-removing claw located at a rear portion of the hammer body. Standard carpenter's hammers include rip-claw or straight-claw hammers, and curved claw hammers used for finish work. One well known problem with a standard straight claw hammer is its inability to remove long nails. Once the nail is removed in the forked claw to a horizontal distance of about one inch to one and a half inches, leverage is lost and the hammer head prevents further removal. Moving the hammer to make contact with the bottom of the nail will provide some additional leverage to further remove the nail, but may cause wood damage or may break or strip the nail head.

There are other problems relating to the removal of longer nails, partially removed nails, bent nails, or partially driven nails. Nails driven into or near a knot in wood must immediately be removed. For this type of nail removal, it is often necessary for a carpenter to use a special nail pulling tool. If a hammer is used, the carpenter must place a block of wood or other hard object underneath the head of the hammer to raise the fulcrum point above the wood surface. This provides greater leverage, but is inefficient in removal of the nail and may result in instability with the hammer handle pulling off to one side.

These problems cause frustration and lost time to a carpenter or user of the standard hammer. A user may need to descend from a ladder or scaffold to search for a piece of wood to use in removing a nail. When removing a series of nails, much time is lost picking up separate objects to assist in removal of each nail.

The hammer of the present invention aids in removal of long nails, short nails, big nails, small nails, or nails with only a small portion of the nail exposed without all the above shortcomings.

OBJECTS AND SUMMARY OF THE INVENTION

An object of the present invention is to provide a strong and effective hammer which can easily and quickly extract nails of various length, including long nails, short nails, nails with large heads and nails with small heads.

Another object of the invention is to provide a hammer capable of removing long nails in addition to shorter nails without adding extra weight or extra size to a regular single claw hammer.

These objects and the general purpose of the invention are accomplished by securing a hook claw, which may be formed in a continuous loop, below the open claw of the hammer or as a part of the open claw of the hammer, to remove nails easily without adding extra size and weight to the hammer. The hook claw has an opening that receives the head of the nail being pulled. Removal of the nail can be started in the regular way with the standard V-shaped claw gripping and pulling the nail out by lifting at the nail head. The hammer is then adjusted to move the nail head of the half-pulled nail into the hook claw. As the hammer is again rotated in a backwards motion, the nail is held by the hook claw forcing the V-claw to grasp the middle portion of the nail as the remainder of the nail is pulled out. Regardless of the nail head size, it could be large, small or nonexistent, the hammer can still remove the nail because pressure is put on the side of the nail, not on the nail head.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The hammer of the present invention includes a standard claw hammer head mounted on one end of a handle. The hammer head may be a standard size with a round striking surface used for hammering nails and a V-claw used for removing and pulling out nails. The hammer of the present invention, in addition to the standard V-claw, includes a smaller hook claw which is positioned to apply pressure to the nail in a direction opposite to the V-claw.

This hook claw may be a part of the metal hammer and is preferably located below the V-claw. It does not contain an open edge in the same direction as the V-claw.

Figure 1:
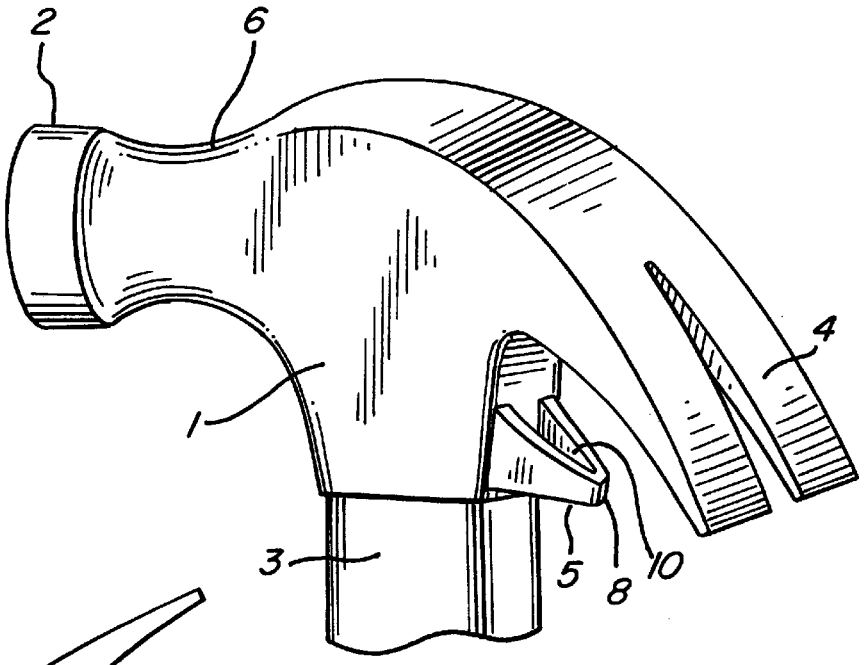
FIG. 1 is a partial perspective view of the present invention.
Figure 2:
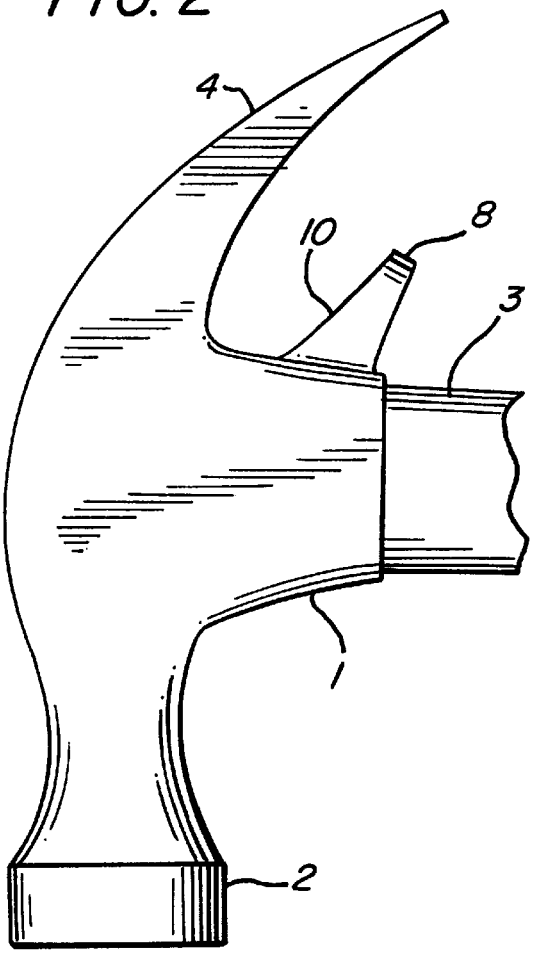
FIG. 2 is a side view of FIG. 1.
Figure 3:
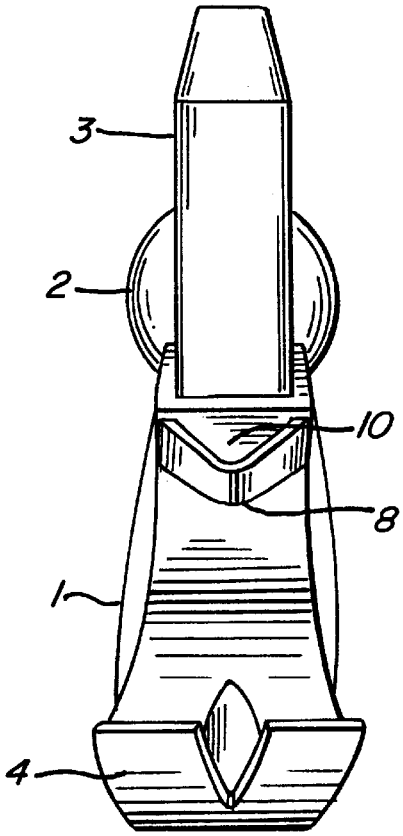
FIG. 3 is a rear angle upside down view of FIG. 1.

Referring to FIGS. 1, 2 and 3, a first preferred embodiment of a hammer according to the present invention is shown having a standard sized head and body 1, a standard wood or metal handle 3, a standard strike portion 6 having a strike face 2 located at the forward portion of the hammer head and a standard rearwardly extending V-claw 4. Under the rearwardly extended V-claw 4 lies an additional hook claw 5. Hook claw 5 is shown as being the opposite of V-claw 4 in that the narrow closed end 8 points away from the hammer handle 3 with the larger section 10, where the nail enters, being attached to the body 1. Hook claw 5 lies below V-claw 4. The hook claw could be any one of a number of convenient shapes, including triangular, for a stronger grip on thinner nail heads, or rounder for easier insertion by nails with larger nail heads.

Figure 4:
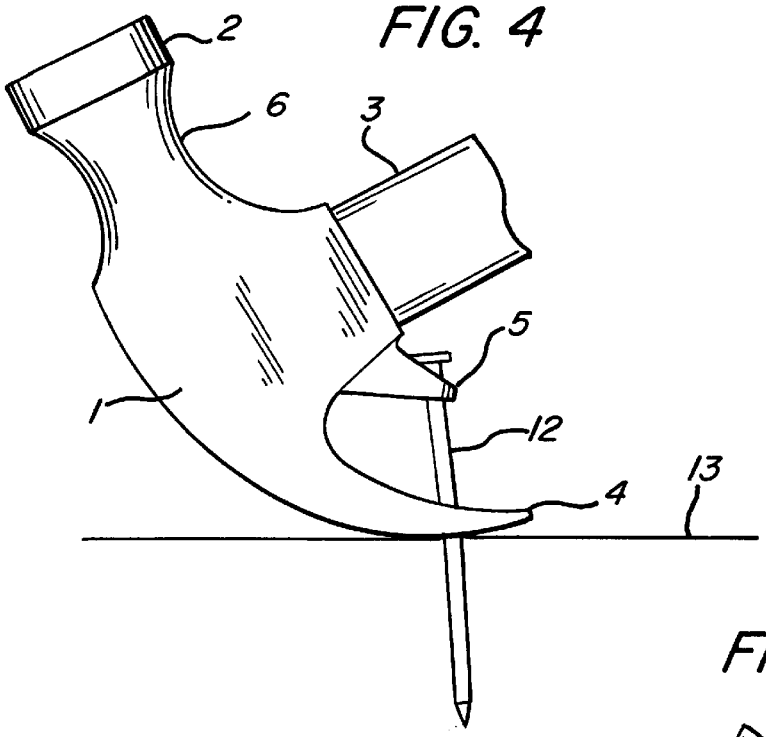
FIG. 4 is a side view of the present invention with a nail locked into a first preferred embodiment of the hook claw before being pulled out.
Figure 5:
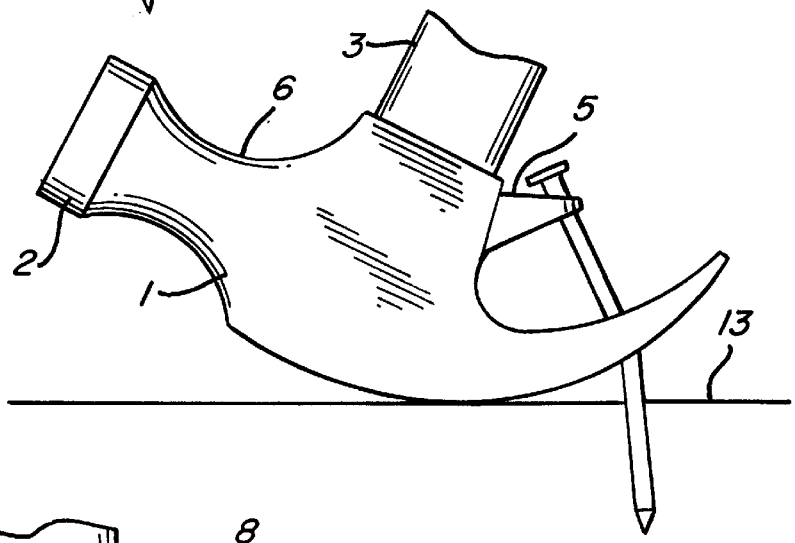
FIG. 5 is a side view of the hammer showing the nail bending slightly and being forced into a tighter grip by the V-claw as the hammer is rotated.
Figure 6:
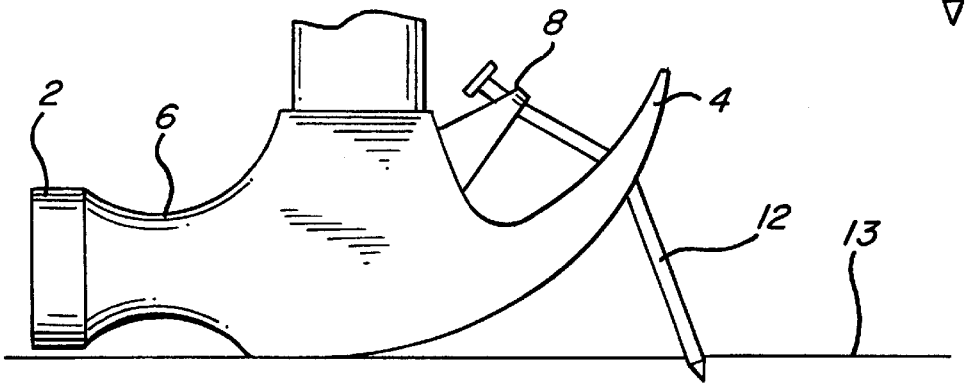
FIG. 6 is a side view of the hammer showing the nail being pulled all the way out as it is gripped by the hook claw and pried free by the hook claw.
Figure 7:
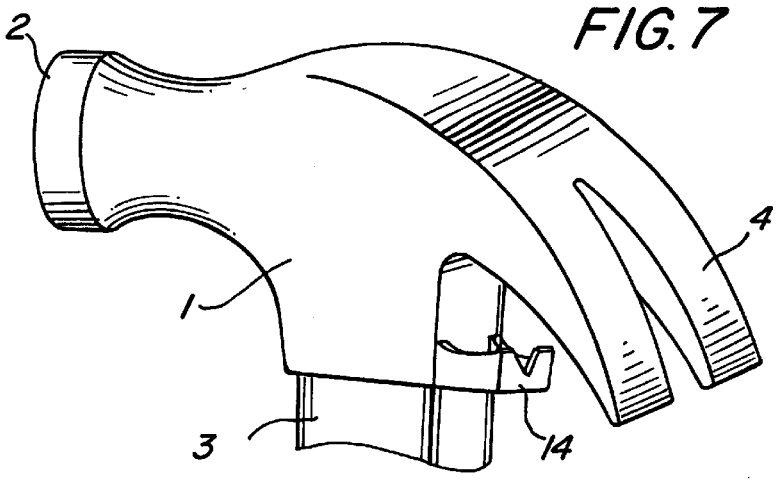
FIG. 7 is a partial perspective view of a hammer with an alternative preferred embodiment of the hook claw.

Referring to FIGS. 4, 5 and 6, the hammer head 1 is shown in its operative position. Placing a nail head into the hook claw 5 is not difficult when the hammer head is angled backwards. A nail head is gripped by the closed end 8 of hook claw 5. Supporting metal siding 11 of the hook claw 5 runs up to body 1 adding strength to the hook claw. FIG. 5 shows a nail 12 locked into hook claw 5 as the V-claw 4 absorbs pressure used in pulling the nail from wood 13. FIG. 6 shows a slight bending of a nail 12 forcing the V-claw 4 to powerfully grip the nail 12. FIG. 7 shows the nail 12 being completely removed by hook claw 5.

FIG. 7 is a perspective of a hammer with an alternate embodiment of the hook claw of the present invention, a smaller V-shaped claw 4 is attached to the hammer body 1 with its "V" pointing in an upward direction to the standard V-claw 4. By applying pressure to a nail in a direction opposite to the V-claw 4, the nail is gripped tightly by hook claw 14.

Figure 8:
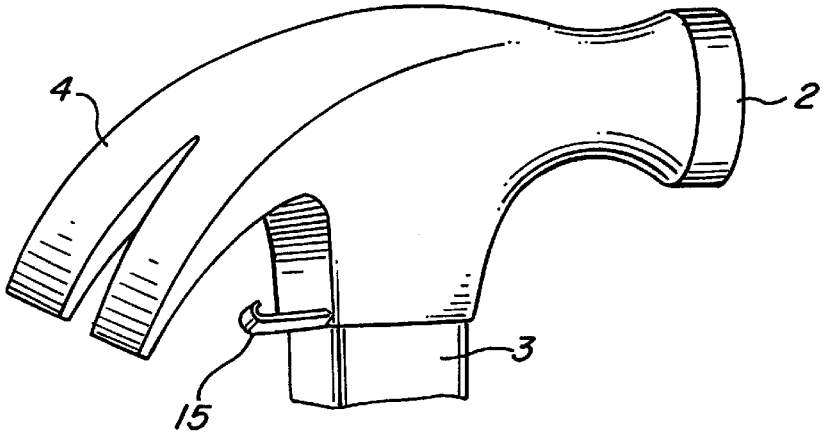
FIG. 8 is a perspective view of the hammer with another alternative preferred embodiment of the hook claw.

FIG. 8 is a perspective of another alternate preferred embodiment of the hook claw of the present invention. The open hook claw 15 is positioned to grasp and pull a nail in the same manner as hook claws 5 and 14, but allows easier entry of a nail.

Figure 9:
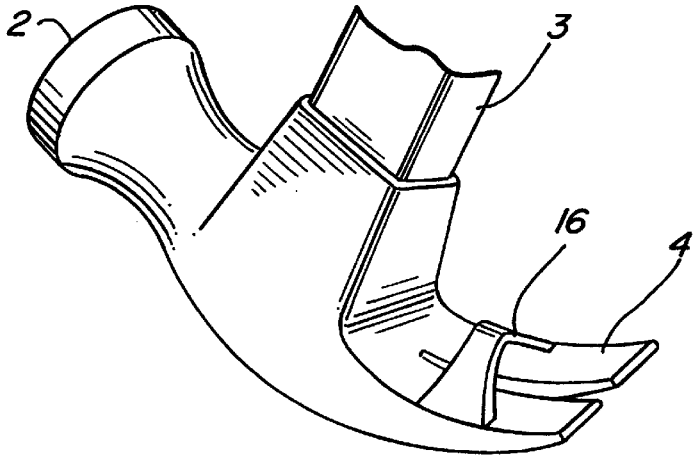
FIG. 9 is a rear angle perspective view of a hammer with yet another preferred embodiment of the hook claw.

FIG. 9 is a rear perspective of the hammer with a closed hook claw 16 attached to the underside of the standard V-claw 4. Hook claw 16 operates like hook claws 5, 14 and 15 applying a force to the nail in a direction opposite to the V-claw, but needs less exposed nail to force the standard V-claw to absorb the pressure and remove the nail. The additional advantage of hook claw 16 is that it weighs very little and does not interfere with standard operation of the hammer V-claw.

Figure 10:
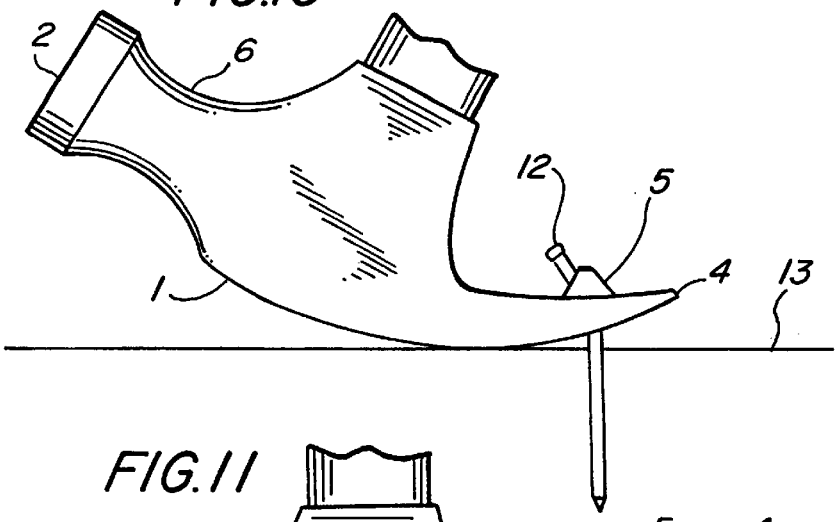
FIG. 10 is a side view of the hook claw of FIG. 9 catching a partially exposed nail without a nail head.
Figure 11:
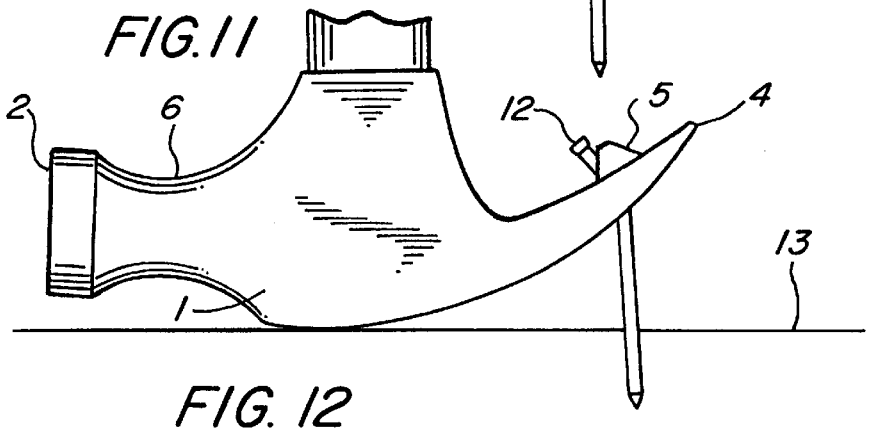
FIG. 11 is a side view demonstrating how the hook claw of FIG. 9 can grasp a nail forcing the V-claw to grip and pull the nail.
Figure 12:
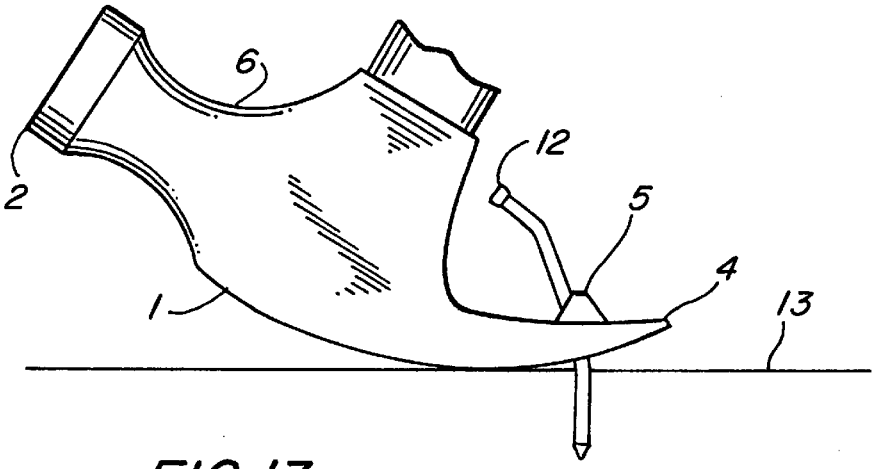
FIG. 12 is a side view of the hook claw of FIG. 9, grasping a partially removed nail.
Figure 13:
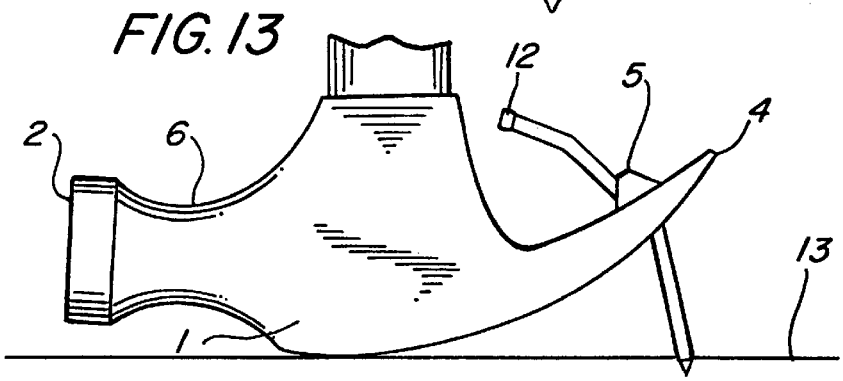
FIG. 13 is a side view of the hook claw of FIG. 9 demonstrating how the hook claw holds the nail as it is pulled out.

FIGS. 10–13 are side views of the hook claw 16 operating on a partially exposed nail 12, partially bending the nail and forcing the V-claw 4 to grasp the nail. FIG. 10 shows hook claw 16 catching the nail. FIG. 11 demonstrates how the hook claw 16 forces the V-claw 4 to grip and pull the nail 12. FIG. 12 shows how the hook claw 16 may grasp the nail in its center and continue pulling it out. FIG. 13 shows how hook claw 16 holds the nail 12, with the V-claw to pull the nail all the way out.

What is claimed is:

1. A double claw hammer, comprising:

a first claw applying a first force in a first direction to a shaft of a nail; and a second V-shaped claw with the wider part of the V being closed and mounted to the hammer with respect to the first claw so as to apply a second force to the shaft of the nail in a second direction opposing the first direction of the first force applied by the first claw, whenever the first and second claw engage the nail for pulling.

2. The double claw hammer of claim 1 wherein the first claw is V-shaped with the wider part of the V being open.

3. The double claw hammer of claim 1 wherein the second claw is mounted to the hammer head.

4. The double claw hammer of claim 1 wherein the second claw is attached to the underside of the first claw.

5. The double claw hammer of claim 4 wherein the second claw has an open end and a closed end, the open end being attached to the first claw.

* * * * *